United States Patent [19]

Averbuch

[11] 4,323,050

[45] Apr. 6, 1982

[54] MACHINE FOR CUTTING PRECIOUS STONES

[76] Inventor: Joseph Averbuch, 10 Dizengoff St., Tel Aviv, Israel

[21] Appl. No.: 147,085

[22] Filed: May 7, 1980

[51] Int. Cl.[3] ..... B28D 5/00

[52] U.S. Cl. ..... 125/30 R

[58] Field of Search ..... 125/30 R, 13; 51/216 R

[56] References Cited

U.S. PATENT DOCUMENTS

| | | | |
|---|---|---|---|
| 835,964 | 11/1906 | Losser | 125/30 R |
| 2,384,253 | 9/1945 | Jearum | 125/30 R |
| 3,445,968 | 5/1968 | Haase | 125/13 R |
| 3,897,772 | 8/1975 | Averbuch | 125/30 R |

FOREIGN PATENT DOCUMENTS

| | | | |
|---|---|---|---|
| 12602 | of 1901 | United Kingdom | 125/30 R |

*Primary Examiner*—Harold D. Whitehead

*Attorney, Agent, or Firm*—Benjamin J. Barish

[57] ABSTRACT

A machine particularly useful for sawing diamonds and other precious stones comprises a pair of horizontally-spaced posts on a stationary frame, each post having a socket open at its upper end of rotatably supporting the horizontal trunnions of a vertical sawing disc holder, each open socket being closable by a cap carried on the inner face of a cover pivotably mounted to each of the posts. The described machine further includes a swingable arm pivotably mounted at one end to the stationary frame, a workpiece holder carried by the opposite end of the swingable arm and rotatable about its longitudinal axis, a threaded pin fixed to the workpiece holder and rotatable therewith about the longitudinal axis of the swingable arm, and a stop fixed to the swingable arm and engageable by the threaded pin to locate the workpiece holder at a predetermined angular position with respect to the swingable arm and to the vertical sawing disc holder.

6 Claims, 9 Drawing Figures

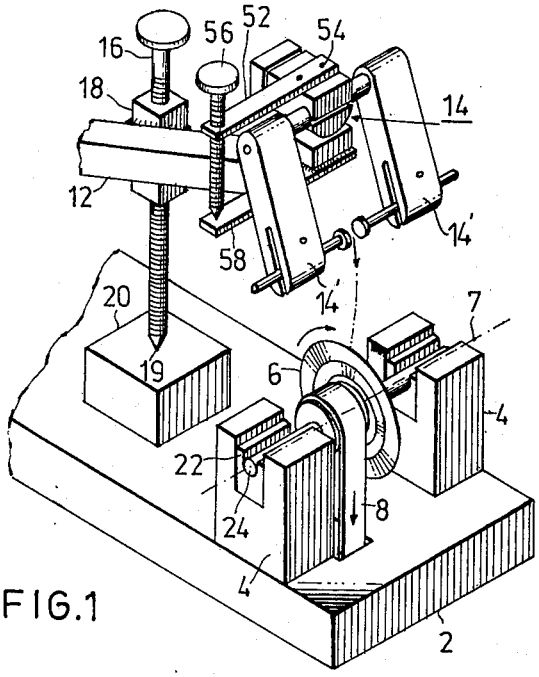
FIG.1
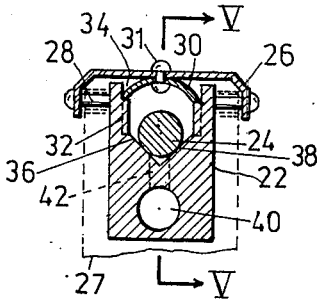
FIG.2
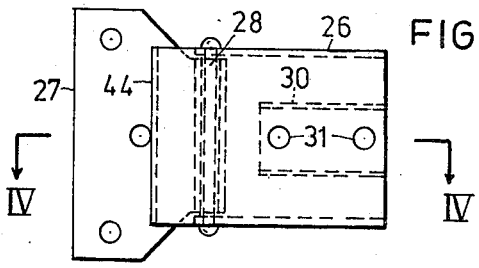
FIG.3
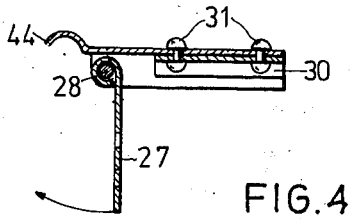
FIG.4
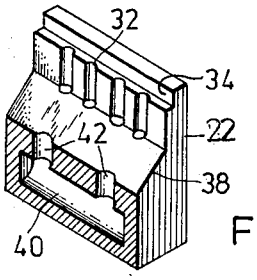
FIG.5
FIG. 8
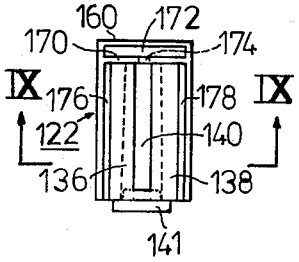
FIG. 9
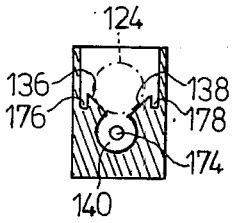
FIG.6
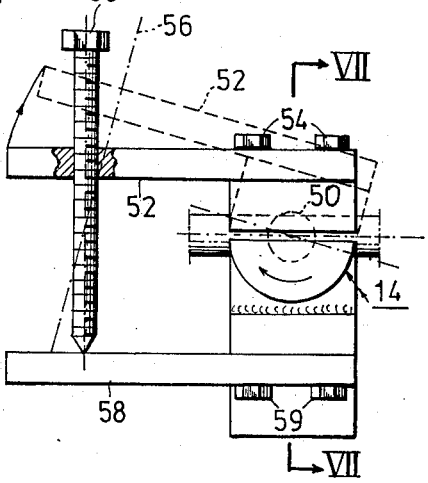
FIG.7
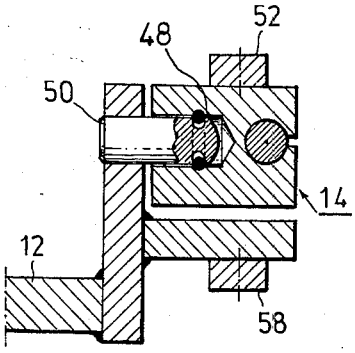

MACHINE FOR CUTTING PRECIOUS STONES

BACKGROUND OF THE INVENTION

The present invention relates to machines which are particularly useful for sawing diamonds and other precious stones.

The conventional diamond sawing machine includes a stationary frame rotatably mounting on its front end a diamond sawing disc and pivotably mounting on its rear end a swingable arm adapted to carry the diamond between a pair of holders or dops and to bring the diamond into engagement with the sawing disc. The sawing disc is supported in a vertical position by a holder having a pair of horizontal trunnions received in open sockets formed in a pair of horizontally spaced posts on opposite sides of the swingable arm carrying the diamond holder, the sockets being lubricated with oil.

Many diamond sawing machines of the foregoing type are now in use. One of the drawbacks in the known machines is that the lubricating oil within the sockets in which the diamond holder trunnions are rotated, tends to be ejected from the sockets by centrifugal forces, thereby requiring the sockets to be frequently relubricated. Another drawback in the known machines arises when the sawing of a relatively large and expensive diamond is not completed at the end of a day's work, in which case the diamond and its holder are removed from the machine, placed in a safe overnight, and then reapplied to the machine the next day for completing the sawing operation; in the known machines, considerable time and skill are required to reapply the diamond and holder to the machine such that the diamond is located precisely at the same angular position with respect to the sawing disc as when the diamond and holder were removed from the machine at the end of the preceding day's work.

BRIEF SUMMARY OF THE INVENTION

An object of the present invention is to provide a machine for sawing precious stones, particularly diamonds, having advantages in both of the above respects.

According to one aspect of the present invention, there is provided a machine particularly useful for sawing diamonds and other precious stones, comprising a stationary frame, a pair of horizontally spaced posts each having a socket open at its upper end for receiving and rotatably supporting the horizontal trunnions of a vertical sawing disc holder, and a cover pivotably mounted to each of said posts and pivotable to an operative position overlying the open socket in its respective post. A cap carried by the inner face of the cover in position to bridge the open end of the respective socket and to close same when the cover is pivoted to its operative position.

In the preferred embodiment of the invention described below, the side walls of each of the sockets are recessed at their upper ends, the lower end of each cap being received within said recess in the operative position of its respective cover.

According to a further feature in the described preferred embodiment, the side walls of each socket are formed with a plurality of vertically extending, horizontally spaced ribs, the upper end of said ribs defining said recessed upper end of the socket side walls receiving the lower ends of the According to a further aspect of the invention, the machine further includes a swingable arm pivotably mounted at one end of the stationary frame, and a workpiece holder carried by the opposite end of the swingable arm and rotatable about the longitudinal axis thereof. A threaded pin is fixed to the workpiece holder and is rotatable therewith about its longitudinal axis, and a threaded pin is fixed to the workpiece holder and is rotatable therewith about the longitudinal axis of the swingable arm. The machine further includes a stop member fixed to the swingable arm and engageable by the threaded pin to locate the workpiece holder at a predetermined angular position with respect to the swingable arm and to the vertical sawing disc holder when supported in the sockets of said posts.

In the preferred embodiment of the invention described below, the threaded pin is threadedly received in an opening formed through a horizontal arm fixed to the workpiece holder; also, the stop member is in the form of a second horizontal arm fixed to said opposite end of the swingable arm to underlie the first horizontal arm.

BRIEF DESCRIPTION OF THE DRAWINGS

Further features and advantages of the invention will be apparent from the description below.

The invention is herein described, by way of example only, with reference to the accompanying drawings, wherein:

FIG. 1 is a three-dimensional view illustrating a portion of a known diamond cutting machine modified in accordance with the present invention, with certain parts removed to show underlying structure;

FIGS. 2–5 relate to one improvement in the machine of FIG. 1, namely an arrangement for minimizing the loss of lubricating oil from the sockets rotatably supporting the sawing disc holder, FIG. 2 being a sectional view of one of the sockets in FIG. 1 for supporting one of the trunnions of the sawing disc holder, FIG. 3 being a top view of the structure of FIG. 2, FIG. 4 being a sectional view along lines IV—IV of FIG. 3, and FIG. 5 being a sectional view along lines V—V of FIG. 2;

FIGS. 6 and 7 relate to another improvement in the machine of FIG. 1, namely an arrangement for enabling the precise re-positioning of the diamond holder with respect to the sawing disc, FIG. 6 being a front plan view of this structure in the machine of FIG. 1, and FIG. 7 being a sectional view along lines VII—VII of FIG. 6;

FIG. 8 is a top plan view of a modified socket construction for supporting one of the trunnions of the sawing disc holder; and FIG. 9 is a sectional view along lines IX—IX of FIG. 8.

DESCRIPTION OF A PREFERRED EMBODIMENT

The diamond sawing machine illustrated in FIG. 1 is of the type described in my prior U.S. Pat. No. 3,897,772. It comprises a stationary frame 2 having at its forward end a pair of posts 4 rotatably mounting a sawing disc 6 about a rotary axis 7, the disc being driven by a belt 8. A swingable arm 12 is pivotable at its rear end (not shown) about an axis parallel to rotary axis 7. The forward end of arm 12 carries a holder 14 for a pair of dops 14' for holding the diamond (not shown) in position to be sawn by the sawing disc 6. The machine further includes an adjustable screw 16 threadedly received within a nut 18 carried by arm 12, the tip 19 of the screw bearing against a resilient block 20 to regulate the extent and speed of the downward movement of arm 12 during the diamond-sawing operation. The pressure applied by the diamond against the sawing disc is controlled by a counter-weight (not shown) fixed to arm 12 on the opposite side of its pivotal axis (not shown).

Further details of the construction and operation of such a diamond sawing machine are available from the above-cited U.S. Patent.

The two posts 4, which are horizontally spaced on opposite sides of the sawing disc 6, are each formed with a socket 22 which is open at its upper end for receiving and rotatably supporting the horizontal trunnions 24 of the holder for the sawing disc 6. As shown particularly in FIGS. 2–4, a cover 26 is pivotably mounted by a mounting plate 27 to one side of each of the two posts 4, the cover being pivotable about axis 28 to an operative position to overlie the open socket in its respective post. A curved cap 30 is secured by fasteners 31 to the inner face of each cover 26 in position to bridge the open end of the socket and to close same when the cover is pivoted to its operative position, as shown in FIG. 2.

More particularly, the opposite side walls of each socket are formed with a plurality of vertically extending, horizontally spaced recesses 32 (FIG. 5) which terminate short of the upper end of the respective socket, so as to define in effect a recessed surface 34 at the upper end of the two side walls of each socket. The two lower ends of each curved cap 30 are received within recess 34 (i.e. they rest against the upper face formed with the recesses 32) in the operative position of the cover. The bottom of the socket is defined by two downwardly inclined walls 36, 38 (FIG. 2) intersecting each other along their center axis. In addition, a recess 40 is formed in each post 4 under its socket 22 and is connected thereto by channels 42.

Preferably, cover 26 is provided with a manipulatable, extension 44 on the opposite side of its pivot axis 28 to facilitate the pivoting of the cover to its open position for inserting or removing the sawing disc holder 6, or to its operative position with its curved cap closing the upper end of socket 22 receiving the sawing disc holder 6.

During the use of the machine, lubricating oil is introduced into recesses 40 of the two posts 4, and the covers 26 on the two posts are pivoted to their closed position as illustrated in FIG. 2. In this position, the lower ends of the cap 30 carried by each cover seats against the upper ends of the ribs 32 formed in the side walls of the respective socket 22, so that the cap forms a substantially flush continuation of the outer face of the ribbed side walls of the socket. Accordingly, when the sawing disc 6 is rotated by belt 8, the curved cap 30 closing the upper ends of each of the two sockets 22 will prevent or reduce the escape of lubricating oil from within the sockets.

As mentioned earlier, when cutting a relatively large expensive stone, the cutting operation may not be completed at the end of a day's work, and therefore it may be necessary to remove the stone and place it in a safe place overnight. This is frequently done by removing the complete diamond holder or dop 14 together with the diamonds. For this purpose, the diamond holder 14 is commonly formed with a bore 48 receiving a pin 50 (FIG. 7) carried at the front end of the swingable arm 12. As also mentioned above, however, when reapplying the holder and diamond to the swingable arm 12 the next day for the continuation of the sawing operation, considerable time and skill are required in order to adjust the position of the diamond holder to locate the diamond precisely at the same angular position with respect to the sawing disc 6 so that the sawing operation may be continued without danger of chipping or otherwise damaging the diamond.

The sawing machine illustrated in FIG. 1, particularly the portion thereof illustrated in FIGS. 6 and 7, provides an arrangement enabling this to be done in a simple, quick and precise manner.

As shown in FIGS. 1, 6 and 7, a bar 52 is fixed, by means of fasteners 54, to the upper side of the diamond holder 14, bar 52 extending laterally of the diamond holder. A threaded pin 56 is threaded through an opening formed in bar 52. A stop member, in the form of a second bar 58, is fixed by fasteners 59 to the lower side of the swingable arm 12 to underlie bar 52, and thereby to be engaged by the threaded pin 56 carried by bar 52.

Thus, before the diamond holder 14 is removed from the end of swingable arm 12, threaded pin 56 is threaded through bar 52 by the diamond holder 14 until the end of pin 56 engages the upper surface of bar 58 carried by the swingable arm 12. The diamond holder 14, including the diamond held thereby, may then be removed from pin 50 at the end of the swingable arm 12 and placed in a safe place for overnight. The next morning, the diamond holder 14 is then reapplied to the swingable arm 12, and is rotated by hand about the axis of pin 50 until the end of threaded pin 56 engages the upper surface of bar 58, which thereby assures that the diamond held by holder 14 will be precisely at the same angular position with respect to the sawing disc 6 as it was when the diamond holder was removed from the machine the preceding day.

FIG. 8, and FIG. 9, which is a sectional view along lines IX—IX of FIG. 8, illustrate a modified socket construction that may be used for supporting each of the trunnions of the sawing disc holder. The modified socket, designated 122 in FIGS. 8 and 9, also includes a pair of downwardly inclined walls 136, 138, defining the surfaces for receiving and rotatably supporting the respective trunnion 124, there being an axially-extending recess or bore 140 underlying these surfaces and communicating therewith via an elongated axially-extending opening 142 for supplying the lubricating oil. The socket construction illustrated in FIGS. 8 and 9 may further include the additional features described above with respect to the sockets illustrated in FIGS. 1–5, although they are not illustrated in order to simplify the drawings.

The socket illustrated in FIGS. 8 and 9, however, further includes, in addition to end wall 160, an intermediate wall 170 closely spaced from end wall 160 and defining therewith a reservoir 172 for the lubricating oil. This intermediate wall 170 is formed with a small opening 174 near its bottom in alignment with the axially extending recess 140 closed by a plug 141 (FIG. 9) for supplying the lubricating oil to this recess at a very slow rate.

In addition, socket 122 illustrated in FIGS. 8 and 9 is further formed with a pair of grooves 176, 178 extending parallel to and laterally of the inclined walls 136, 138 adapted to receive and rotatably support the trunnions 124 of the sawing disc holder.

During the rotation of the trunnions on surfaces 136, 138, the trunnions are continuously lubricated by the oil supplied from reservoir 172 via metering opening 174, recess 140, and openings 142, and any shavings or other dirt particles in the oil are thrown outwardly by centrifugal force and accummulate within the grooves 176, 178, thereby keeping the oil lubricating the relatively rotating surfaces substantially clean. The dirt accummulated within the grooves 176, 178 may be periodically removed by scraping with a pointed instrument.

It will be appreciated that many other variations, modifications and applications of the invention may be made.

What is claimed is:

1. A machine particularly useful for sawing diamonds or other precious stones, comprising: a stationary frame; a pair of horizontally spaced posts each having a socket open at its upper end for receiving and rotatably supporting the horizontal trunnions of a vertical sawing disc holder; a swingable arm pivotably mounted at one end to said stationary frame; a workpiece holder removably carried by the opposite end of said swingable arm and rotatable about the longitudinal axis thereof; a threaded pin fixed to said workpiece holder and rotatable therewith about the longitudinal axis of the swingable arm; and a stop member fixed to said swingable arm and engageable by said threaded pin to locate the workpiece holder at a predetermined angular position with respect to the swingable arm and to the vertical sawing disc holder when the workpiece holder is removed from, and then reapplied to, said swingable arm.

2. A machine according to claim 1, wherein said threaded pin is threadedly received in an opening formed through a horizontal arm fixed to the workpiece holder.

3. A machine according to claim 1, wherein said stop member is in the form of a second horizontal arm fixed to said opposite end of the swingable arm to underlie the first horizontal arm.

4. A machine according to claim 1, wherein each of said sockets includes an end wall and an intermediate wall closely spaced from one end wall and defining therewith a reservoir for the lubricating oil, said intermediate wall being formed with a small opening for metering the oil from said compartment into said axially-extending recess.

5. A machine according to claim 1, wherein at least one side wall of each socket is formed with a dirt accummulating groove extending parallel to and laterally of the socket surface supporting the horizontal trunnion of the sawing disc holder.

6. A machine according to claim 5, wherein both side walls of said socket are formed with said dirt-accummulating groove, which grooves are disposed on opposite sides of said socket surface supporting the horizontal trunnion of the sawing disc holder.

* * * * *